US005715659A

United States Patent [19]

Norton

[11] Patent Number: 5,715,659

[45] Date of Patent: Feb. 10, 1998

[54] TRANSFER SYSTEM FOR TRANSFERRING OBJECTS INTO A BARRIER ISOLATOR

[75] Inventor: Paul H. Norton, Trumbauersville, Pa.

[73] Assignee: The West Company, Incorporated, Lionville, Pa.

[21] Appl. No.: 794,029

[22] Filed: Feb. 3, 1997

[51] Int. Cl.[6] ..... B65B 55/00

[52] U.S. Cl. ..... 53/492; 53/167; 53/381.2; 414/292; 414/412

[58] Field of Search ..... 53/167, 381.2, 53/425, 426, 492; 156/251, 515; 141/85, 93, 97; 414/292, 403, 412

[56] References Cited

U.S. PATENT DOCUMENTS

| | | | |
|---|---|---|---|
| 3,016,284 | 1/1962 | Trexler . | |
| 3,289,698 | 12/1966 | Cazalis et al. . | |
| 3,893,578 | 7/1975 | Melton et al. | 414/412 |
| 4,724,874 | 2/1988 | Parikh et al. | 414/292 X |
| 4,805,378 | 2/1989 | Anderson | 53/381.2 X |
| 4,916,885 | 4/1990 | Loliger | 53/381.2 X |
| 4,991,633 | 2/1991 | Wong . | |
| 5,117,875 | 6/1992 | Marrucchi | 141/97 X |
| 5,257,957 | 11/1993 | Diccianni et al. . | |
| 5,259,812 | 11/1993 | Kleinsek . | |
| 5,275,479 | 1/1994 | Cruz et al. . | |
| 5,447,699 | 9/1995 | Papciak et al. . | |
| 5,460,439 | 10/1995 | Jennrich et al. . | |

*Primary Examiner*—Daniel Moon

*Attorney, Agent, or Firm*—Panitch Schwarze Jacobs & Nadel, P.C.

[57] ABSTRACT

A transfer system for transferring objects into a barrier isolator is provided. The transfer system includes a port opening located in a barrier wall to provide access to an isolated space. A port barrier film is sealingly located over the port opening, with the port barrier film having a first, decontaminated side which faces the isolated space and a second side which is exposed. A container adapted to hold the objects to be delivered through the port opening and into the isolated space is provided. A container barrier film is sealingly engaged to the container opening such that decontaminated objects sealed within the cavity in the container remain decontaminated. The container barrier film has a first, decontaminated side which faces the cavity and a second exposed side. The container barrier film is positioned adjacent to the port barrier film, and a parting and sealing element, located within the isolated space is adapted to part the container and port barrier films to form a transfer opening having edges in the port and container barrier films and to simultaneously seal together and decontaminate the edges of the port and container barrier films such that the exposed and potentially contaminated second sides of the port and container barrier films are locked together and remain isolated from the isolated space.

15 Claims, 5 Drawing Sheets

Fig. 3
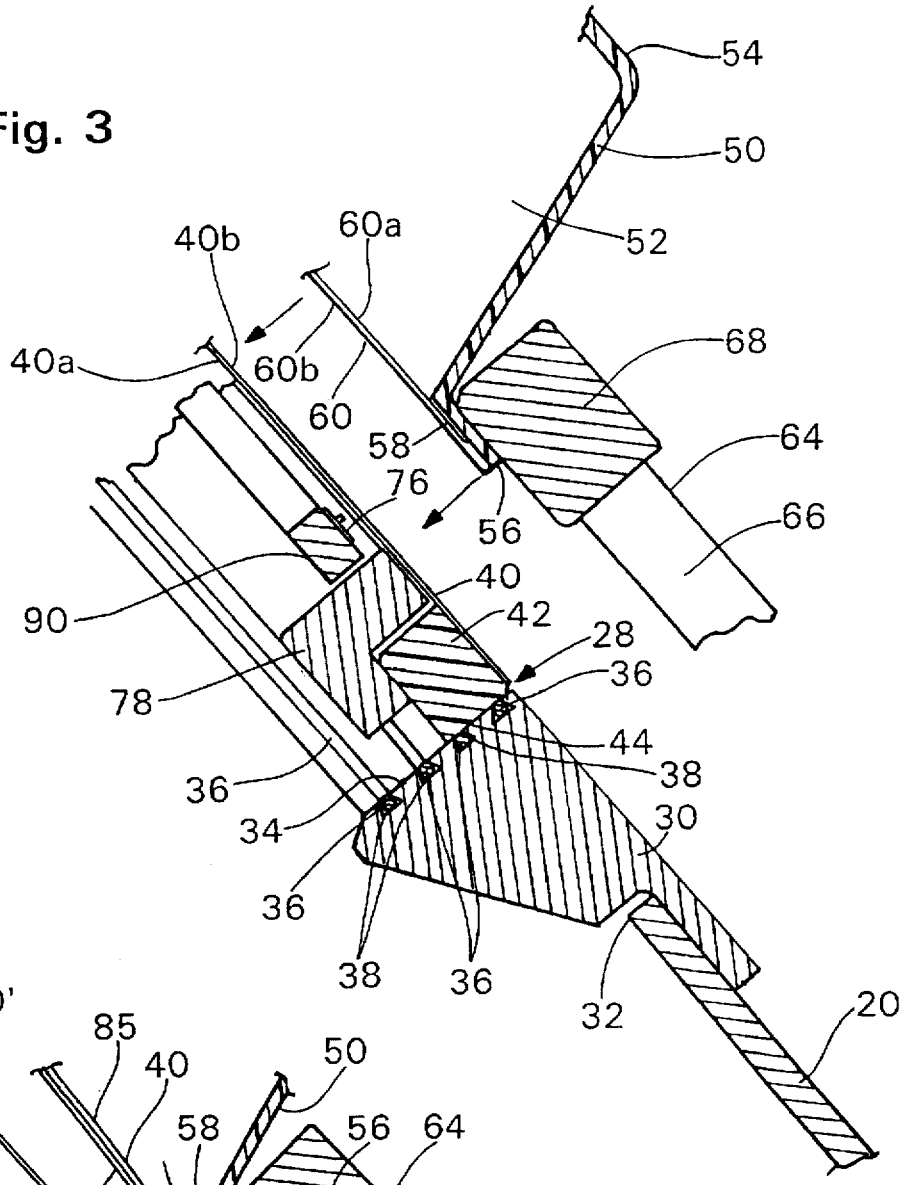
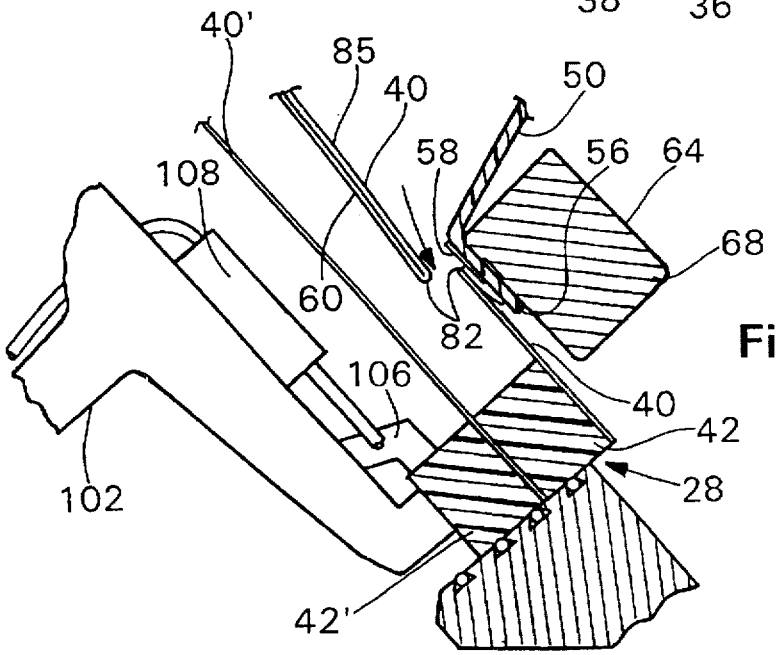
Fig. 6

TRANSFER SYSTEM FOR TRANSFERRING OBJECTS INTO A BARRIER ISOLATOR

BACKGROUND OF THE INVENTION

The present invention relates to isolated rooms and/or equipment for maintaining an aseptic environment, and in particular, to a system for transferring sterile objects into such an isolated space.

In the past, the production and handling of certain products, such as pharmaceuticals, was carried out in a clean room in order to avoid contamination of the product during processing. The clean room was maintained as an isolated, aseptic area and equipment or other objects entering the isolated area, such as consumables used during the processing of such products, had to be sterilized prior to being introduced into the aseptic environment. Additionally, personnel working in such rooms were required to wear protective clothing to prevent contamination of the area.

Recently, in order to reduce the expenses associated with operating a clean room, barrier-isolated equipment has been introduced which maintains a local aseptic environment directly around processing equipment for certain types of products. The equipment is accessed through glove portals and objects are sterilized and transferred into the isolated area via air locks. The objects being introduced into the isolated area can be presterilized or are sterilized within the air lock prior to being introduced into the barrier isolated area. Generally, each machine or isolated area would require an air lock or treatment vessel which receives the articles to be sterilized, such as closure elements for pharmaceutical containers. The closure elements are then sterilized within the treatment vessel prior to being passed into the isolated system.

It would be desirable to reduce the time required and cost involved for sterilizing parts or other materials which are to be introduced into an isolated system on site.

One solution to this problem, which is described in U.S. Pat. No. 5,447,699, which was jointly invented by the present inventor and is assigned to the assignee of the present invention, provides a combination container for holding sterilized elements such as vial stoppers and a sterilizable transfer port for transferring the sterilized elements into the isolation system. However, exposed areas of the transfer port components must still be sterilized on site prior to the transfer of elements into the isolation system. This allows the required elements to be sterilized at a different location prior to shipping to the processing and packaging company where the sterilized elements are fed into the isolation system, such as a system for bottling pharmaceuticals.

BRIEF SUMMARY OF THE INVENTION

Briefly stated, the present invention provides a transfer system for transferring objects into a barrier isolator which includes a barrier wall to maintain a decontaminated environment in an isolated space. The transfer system includes a port opening located in the barrier wall to provide access to the isolated space. A port barrier film is sealingly located over the port opening, with the port barrier film having a first, decontaminated side which faces the isolated space and a second side which is exposed. A container adapted to hold the objects to be delivered through the port opening and into the isolated space is provided. The container has an interior cavity adapted to receive decontaminated objects, an exposed exterior, and a flange. A container barrier film is sealingly engaged to the flange such that decontaminated objects sealed within the cavity in the container remain decontaminated. The container barrier film has a first, decontaminated side which faces the cavity and a second exposed side. A holder is located adjacent to the port opening and is adapted to position the container adjacent to the port opening, with the second side of the port barrier film in facing engagement with the second side of the container barrier film. A parting and sealing element is located within the isolated space adjacent to the port opening and is mounted for movement from a first position to a second, in-use position adjacent to the first side of the port barrier film where the parting and sealing element is adapted to part the port and container barrier films to define a transfer opening having edges in the port and container barrier films and to simultaneously seal together and decontaminate the edges of the port and container barrier films such that the exposed and potentially contaminated second sides of the port and container barrier films are locked together and remain isolated from the isolated space. This allows the objects from within the container cavity to be passed through the transfer opening and into the isolated space while maintaining the decontaminated environment.

In another aspect, the present invention provides a transfer system for transferring objects into a barrier isolator which includes a barrier wall to maintain a decontaminated environment in an isolated space. The transfer system includes a port opening located in the barrier wall to provide access to the isolated space. A port barrier film is sealingly located on the port opening. The port barrier film has a first, decontaminated side which faces the isolated space and a second side which is exposed. A container is provided which is adapted to hold the objects to be delivered through the port opening and into the isolated space. The container has an interior cavity adapted to receive decontaminated objects, an exposed exterior, and a flange. A container barrier film is sealingly engaged to the flange such that decontaminated objects are adapted to be sealed within the cavity in the container and remain decontaminated in the cavity. The container barrier film has a first, decontaminated side which faces the cavity, and a second exposed side. A holder is located adjacent to the port opening and is adapted to position the container adjacent to the port opening, with the second side of the port barrier film in facing engagement with the second side of the container barrier film. A heating element is located within the isolated space adjacent to the port opening and is alignable with at least a portion of the port and container barrier films.

In another aspect, the present invention provides a method of supplying decontaminated objects to a decontaminated environment in an isolated space delimited by a barrier wall. The method comprises the steps: (a) providing a port opening in the barrier wall which is sealed by a port barrier film with a first, decontaminated side facing the isolated space to close-off the isolated space and a second exposed side; (b) clamping a container to the port opening, the container having a decontaminated interior cavity with decontaminated objects sealed within the cavity by a container barrier film, the container barrier film having a first decontaminated side and a second exposed side, the second side of the port barrier film being in facing engagement with the second side of the container barrier film; (c) simultaneously creating a transfer opening in the port and container barrier films and sealing together edges formed around the transfer opening in the port and container barrier films with a parting and sealing element located inside the contained space; and (d) transferring the decontaminated objects from within the container, through the transfer opening in the port and container barrier films and into the isolated space.

BRIEF DESCRIPTION OF SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 3. is an enlarged cross-sectional view taken along line 3—3 in FIG. 2 showing a container being positioned adjacent to the port opening for transferring objects into the barrier isolator;

FIG. 6 is a cross-sectional view similar to FIG. 3 showing the installation of a next port barrier into the port opening;

DETAILED DESCRIPTION OF THE INVENTION

Figure 1A:
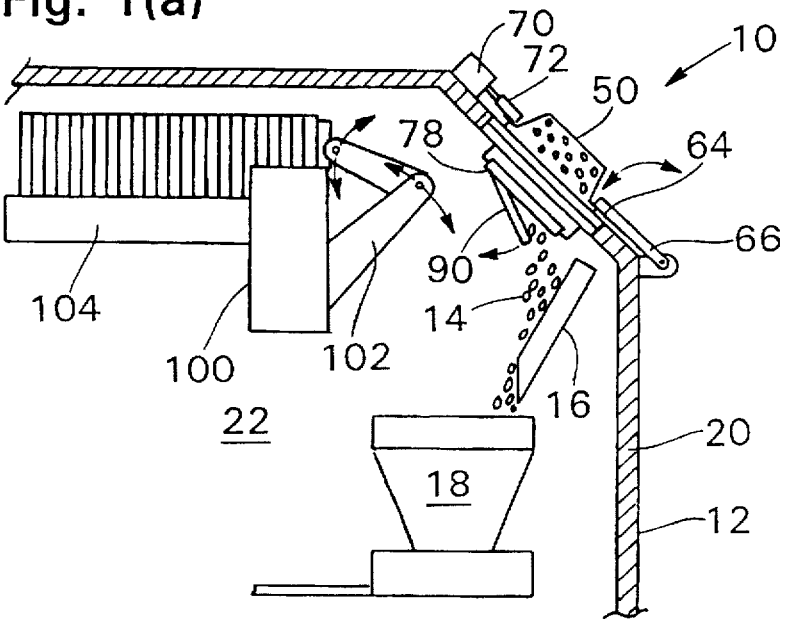
FIG. 1(*a*)–FIG. 1(*f*) are sequential side elevational views showing the operation of a transfer system for transferring objects into a barrier isolator in accordance with the present invention.
Figure 1B:
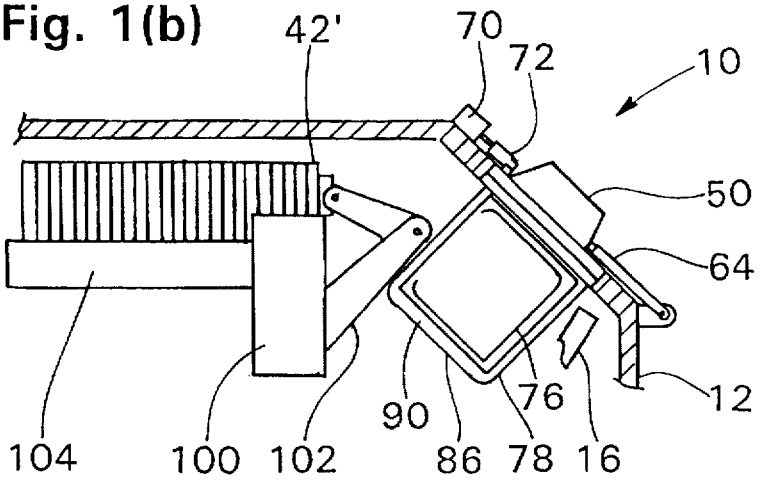
Figure 1C:
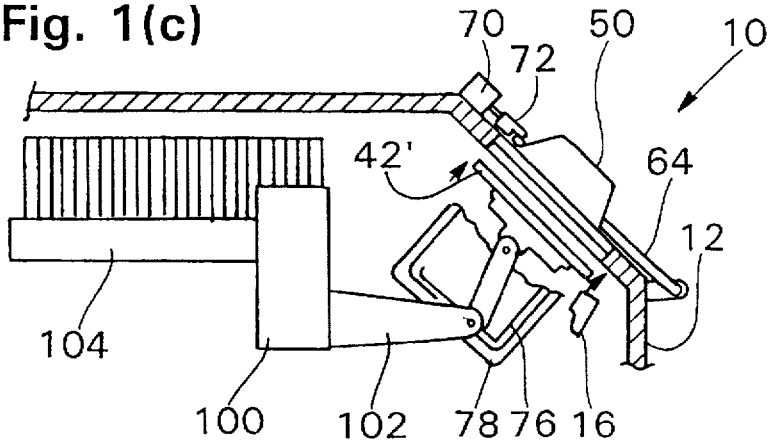
Figure 1D:
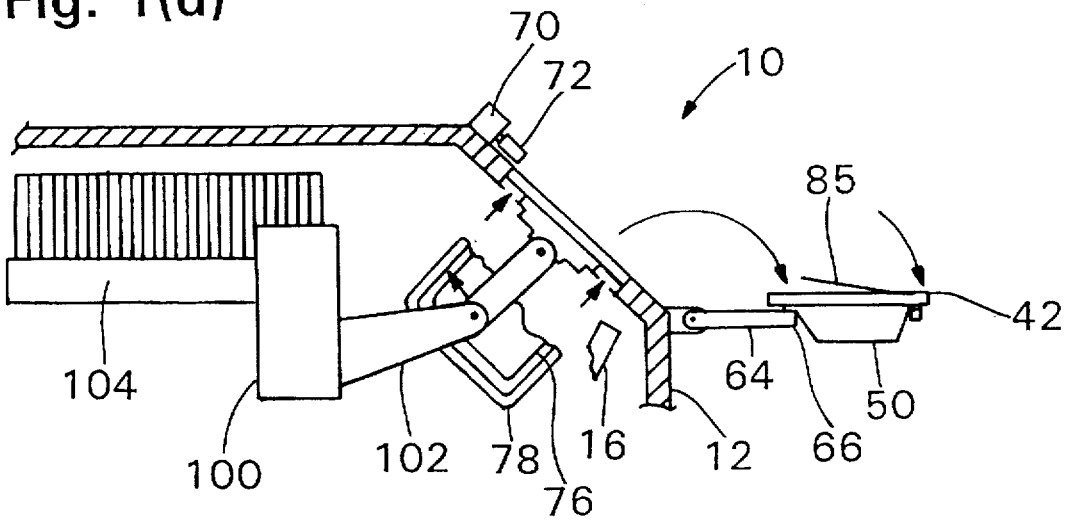
Figure 1E:
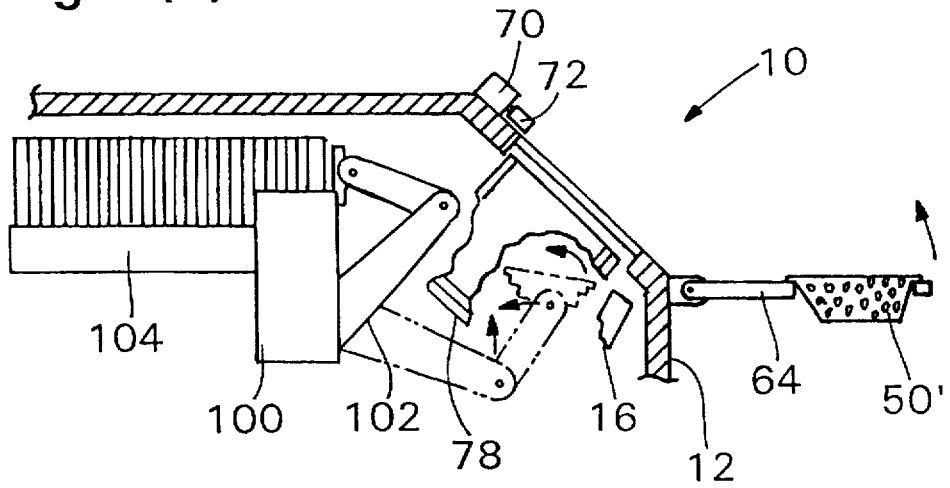
Figure 1F:
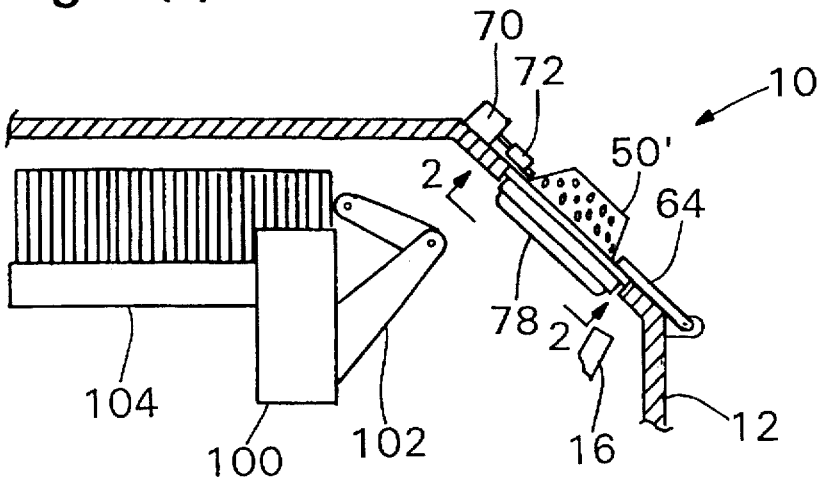

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the transfer system 10 for transferring objects into a barrier isolator 12 and designated parts thereof. The terminology includes the words above specifically mentioned, derivatives thereof and words of similar import.

Referring to the drawings, wherein like numerals indicate like elements throughout, there is shown in FIG. 1(*a*)–FIG. 1(*f*) the transfer system 10 for transferring objects 14 into a barrier isolator 12. In the preferred embodiment, the barrier isolator 12 is used to enclose equipment used in bottling pharmaceutical products in an aseptic environment, and preferably, the objects 14 are vial stoppers which are directed by a chute 16 into a hopper 18 which feeds the stoppers to the bottling equipment.

The barrier isolator 12 includes a barrier wall 20, most completely illustrated in cross-section in FIG. 1(*a*), which maintains a decontaminated environment in an isolated space 22 enclosed by the barrier wall 20. The barrier wall 20 is preferably made of an impermeable material and may be sized to enclose a piece of equipment or an entire production line depending upon the particular application. For the purposes of the present application, the barrier wall 20 is meant to refer to any dividing member used to isolate an enclosed space.

Figure 2:
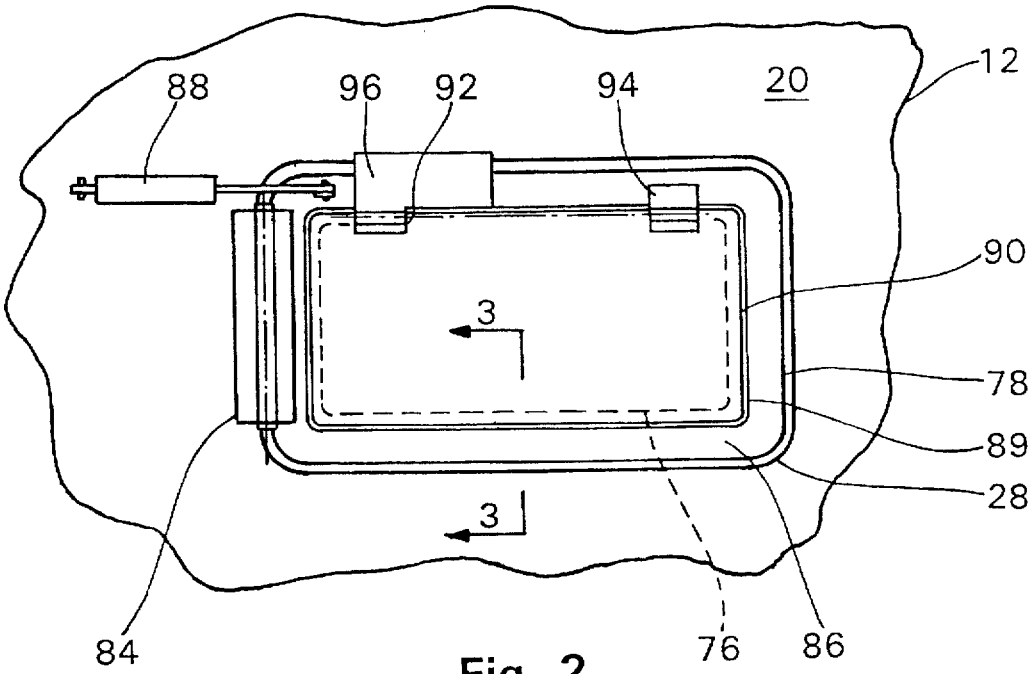
FIG. 2 is a view taken along line 2—2 of FIG. 1(*f*)

Referring now to FIG. 2, a port opening 28 is located in the barrier wall 20 to provide access to the isolated space 22. Preferably, the port opening 28 is surrounded by a reinforcement 30 shown in greater detail in FIG. 3, which extends around an opening 32 in the barrier wall 20. The reinforcement 30 has a surface 34 which surrounds the port opening 28 and a predetermined depth. Preferably, a plurality of spaced apart annular seals 36 which surround the port opening 28 are located on the surface 34. Preferably, the annular seals 36 are located in the dovetail grooves 38 in the surface 34 of the reinforcement 30. In the preferred embodiment, at least two annular seals 36 are provided, and more preferably four annular seals are used. However, it will recognized by those skilled in the art from the present disclosure that the reinforcement 30 could be formed integrally with the barrier wall 20, and need not be a separate part attached in an opening in the barrier wall 20.

The annular seals 36 are preferably round in cross section, and protrude above the surface 34 from the dovetail grooves 38. However, it will be recognized by those skilled in the art from the present disclosure that other types of seals could be used, if desired, such as a flap or wiper seals mounted directly to the surface 34 of the reinforcement 30.

Referring to FIG. 3, a port barrier film 40 is sealingly located over the port opening 28. The port barrier film 40 has a first, decontaminated side **40*a* which faces the isolated space 22 and a second side 40*b* which is exposed. Preferably, the port barrier film 40 is mounted in a frame 42 having an outer periphery 44 which is complementary and designed for a minimal clearance fit with the port opening 28. The outer periphery 44 of the frame 42 is sealingly engaged by at least one annular seal 36. The frame 42 is also slidably displacable through the port opening 28 along the surface 34 while maintaining sealed contact around the entire outer periphery of the frame 42 with one or more of the annular seals 36**.

In the preferred embodiment, the frame 42 is made of a polymeric material, such as polyethylene. However, it will be understood that the frame can be made from a metallic material or any other suitable impermeable material, if desired. Each frame 42 has a thickness to provide a desired rigidity, and the thickness is preferably 0.5 inches or greater. Preferably, the depth of the reinforcement surface 34 is greater than the thickness of two frames 42 such that a first frame 42 can be displaced outwardly from the opening while a second frame 42' is sealingly engaged by at least one annular seal 36 in the port opening 28 to maintain isolation of the isolated space 22 as the frame 42 is removed, as shown in detail in FIG. 6, which will be explained in more detail below.

Referring to FIGS. 1(*a*) and 3, a container 50 which is adapted to hold the objects 14 to be delivered through the port opening 28 and into the isolated space 22 is provided. As shown in FIG. 3, the container 50 includes an interior cavity 52 adapted to receive decontaminated objects 14, and a flange 56 which extends outwardly around the opening to the interior cavity 52. The container exterior 54 is exposed in use. Preferably, the container 50 is made of a single piece of thermoformed polymeric material, and the flange 56 is integrally formed with the container 50. However, it will be recognized by those skilled in the art from the present disclosure that other materials can be used to made the container 50 and that the container 50 could be made from more than one piece of material, if desired.

Still with reference to FIG. 3, in the first embodiment, a shield 58 is located on an inner periphery of the flange 56 of the container 50 to prevent the parting and sealing element 76 from acting on the flange 56, as explained in detail below. The shield 58 is preferably a thin sheet of heat resistant material, such as aluminum foil or other metallic foil which is attached to the surface of the flange 56. However, it will be recognized by those skilled in the art from the present disclosure that the shield 58 can be omitted if the flange 56 itself is made of a suitable heat resistant material.

A container barrier film 60 is engaged to an outer periphery of the flange 56 such that the decontaminated objects 14 are adapted to be sealed within the interior cavity 52 in the container 50 and remain decontaminated in the cavity 52. The container barrier film 60 has a first, decontaminated side 60*a* which faces the cavity 52, and a second exposed side 60*b* which is exposed to outside air.

Preferably, both the port and container barrier films 40 and 60 are made of a polymeric material such as polyethylene having a thickness of approximately 0.004 inches. The container barrier film 60 is preferably connected to the flange 56 by an adhesive or a heat sealed connection between the outer most periphery of the container barrier film 60 and the flange 56. No connection is provided between the container barrier film 60 and the shield 58, and the barrier film 60 is releasable from the shield 58. The port barrier film 40 is attached to the port frame 42 in a similar manner.

Referring now to FIGS. 1(*a*)–1(*f*) and FIG. 3, a holder 64 is located adjacent to the port opening 28. The holder 64 preferably includes a hinged arm 66 which is connected to a support frame 68 having an opening defined therethrough for receiving the container 50, with the flange 56 of the container 50 being supported on the frame 68. A latching mechanism 70, shown in FIGS. 1(*a*)–1(*f*), is attached to the outside of the barrier isolator 12 and includes a movable latch element which contacts the support frame 68 to lock the container 50 in position adjacent to the port opening 28, with the second side 40*b* of the port barrier film 40 being in facing engagement with the second side 60*b* of the container barrier film 60. Preferably, the latching mechanism 70 includes an solenoid actuated latch 72 which is adapted to engage the container holder frame 68 to hold the container holder 64 in position. Solenoid actuated mechanisms which are used as latching elements are generally known in the art. Accordingly, further description is not believed to be necessary. It will be recognized by those skilled in the art from the present disclosure that any type of latching mechanism, such as a manually engaged latch, can be used, if desired, to hold the container holder 64 with the container 50 in position. It will be similarly recognized that the latching mechanism 70 may be omitted depending upon the configuration and position of the container holder 64 and the container 50. For example, if the combined weight of the container holder 64 and container 50 is sufficient to maintain the container 50 in position.

Figure 4:
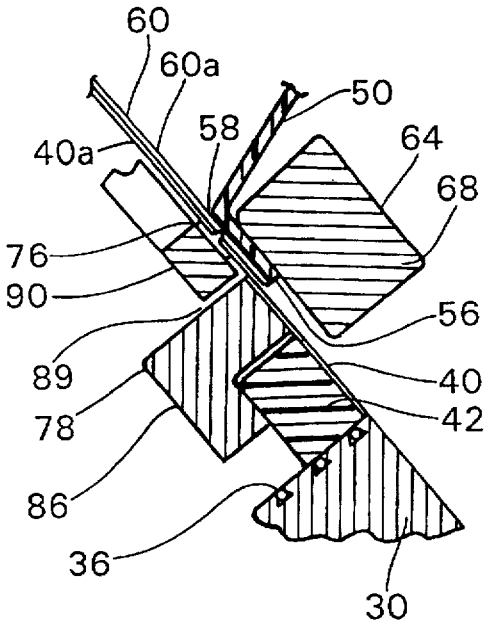
FIG. 4 is an enlarged cross-sectional view similar to FIG. 3 showing the parting and sealing element forming an opening in the barrier films.
Figure 5:
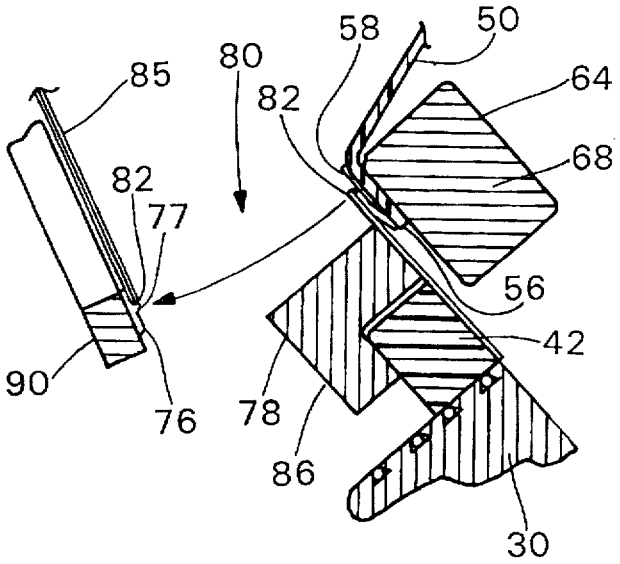
FIG. 5 is an enlarged cross-sectional view similar to FIG. 3 showing the container opening for transferring objects into the barrier isolator.

Referring now to FIGS. 1(*b*), 1(*f*), 2 and 4, a parting and sealing element 76 is located within the isolated space 22 adjacent to the port opening 28. The parting and sealing element 76 is mounted for on a door assembly 78 for movement from a first position, shown in FIG. 1(*b*), to a second, in-use position adjacent to the first side 40*a* of the port barrier film 40, as shown in FIGS. 1(*f*), 3 and 4. The parting and sealing element 76 is used to part the port and container barrier films 40 and 60 as shown in FIG. 5 to define a transfer opening 80 having edges 82 in the port and container barrier films 40 and 60. The parting and sealing element 76 is used to simultaneously seal together and decontaminate the edges 82 of the port and barrier films 40 and 60 such that the exposed and potentially contaminated second sides 40*b*, 60*b* of the port and container barrier films 40, 60 are locked together and remain isolated from the isolated space 22. Preferably, the parting and sealing element 76 is aligned with the shield 58 covered area of the flange 56, as shown in FIG. 4. The shield 58 is located on the flange to prevent the barrier films 40, 60 from adhering to a portion of the flange 56 during the parting and sealing operation.

Figure 8:
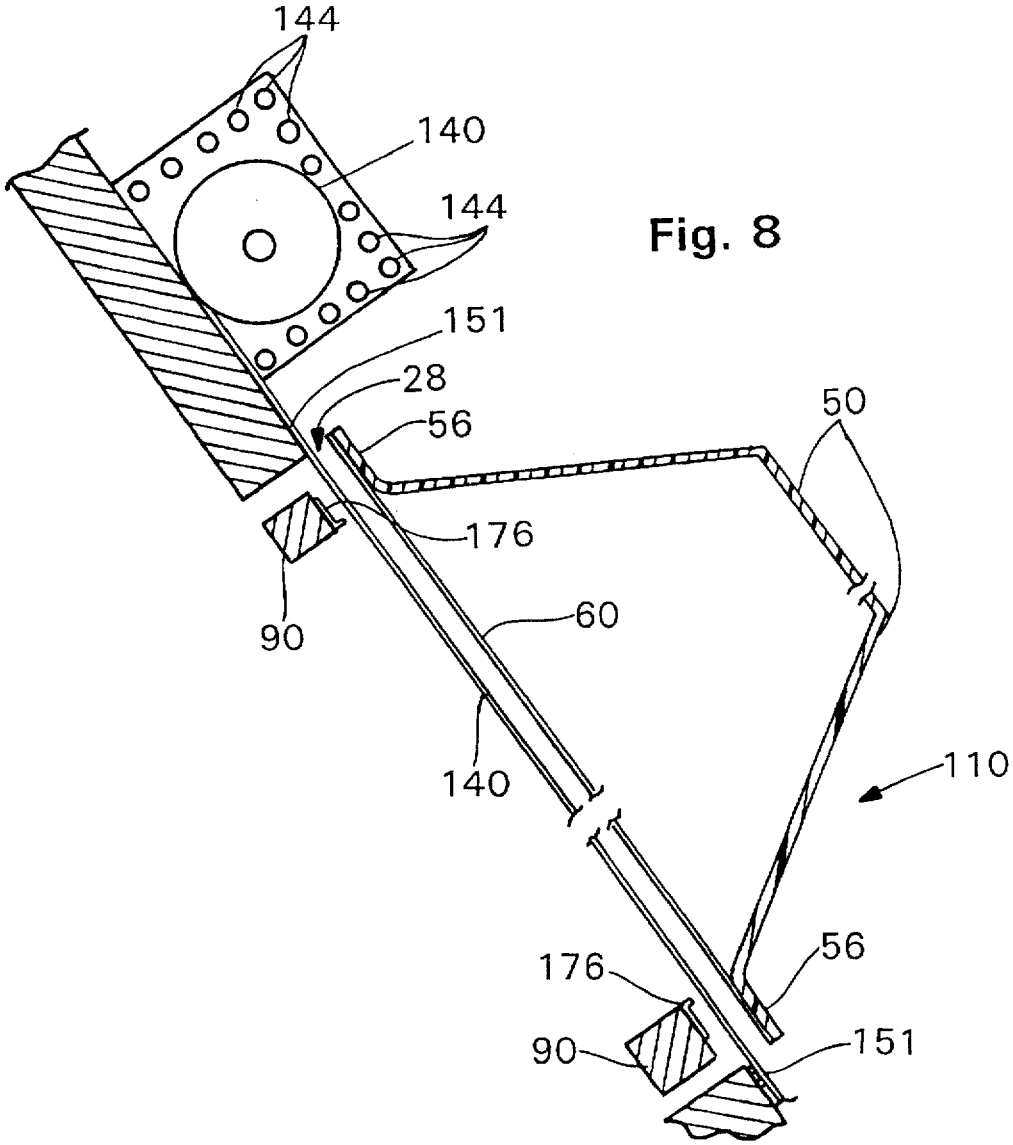
FIG. 8 is a cross-sectional view taken along line 8—8 in FIG. 7.

It is also possible to align the parting and sealing element 76 along an inside edge of the flange 56, as shown in FIG. 8 in connection with the second embodiment of the invention, while using an external member (not shown) to apply external pressure to the container 50 for support during the parting of the barrier films 40, 60 while simultaneously sealing together and decontaminating the edges. In this case, the shield 58 is also not required.

As shown in detail in FIG. 5, preferably the parting and sealing element 76 is a heating element having a raised portion 77 which is used to simultaneously part the barrier films 40, 60, seal the edges 82 together, and decontaminate the edges 82 around the opening 80 to ensure that the isolated space is not contaminated. One preferred heating element is available from Toss Machine Components of Nazareth, Pa.

As best shown in FIG. 2, the parting and sealing element 76 extends around at least two, and preferably three sides of the flange 56 of the container 50, and is adapted to form a flap 85 from the port and container barrier films 40, 60. The edges 82 along both the flap 85 and the opening 80 are simultaneously sealed and decontaminated by the parting and sealing element 76.

Referring now to FIG. 2, the door assembly 78 is preferably connected to the wall 20 of the barrier isolator by hinge 84 which allows the door assembly 78 to be swung from a closed position, as shown in FIG. 1(*f*) to an open position as shown in FIG. 1(*b*). As shown in FIGS. 2 and 4, the door assembly 78 includes an outer door frame 86 to which the first hinge 84 is connected. Preferably, an actuator 88 is connected between the barrier wall 20 and the outer frame 86 to open and close the door. The actuator 88 can be electrically or pneumatically operated, preferably from a remote location outside of the isolated space 22. An opening 89 is provided in the outer door frame 86, and an inner door 90 is located in the opening 89. The inner door 90 is supported by hinges 92, 94. Preferably, an actuator 96 is provided for moving the inner door 90 relative to the outer door frame 86, as shown in FIG. 1(*a*). The parting and sealing element 76 is supported by the inner door 90. The inner door 90 also acts a support for the flap 85, which is movable between a first position, as shown in FIGS. 1(*f*) and 4, in which the inner door 90 is adapted to engage the flap 85 and hold the flap 85 in a closed position, and a second position as shown in FIGS. 1(*a*) and 5 in which the inner door moves away from the port opening 28, allowing the flap 85 to open.

Referring now to FIGS. 1(*a*)–1(*f*), once the sterilized objects 14 are transferred from the container into the isolated space 22, a new port frame 42' with an uncut barrier film 40 is placed in the port opening 28 from inside the barrier isolator 12, and is sealingly engaged by annular seals 36 adjacent to the inner edge of the reinforcement 30.

Preferably a robot 100 with an arm 102 is used to load new port barrier frames 42' into the port opening 28. In FIG. 1(*a*), the arm 102 is shown in position to pick up a next port barrier frame from a magazine 104 which holds additional frames 42 located inside the barrier isolator 12. Referring to FIG. 6, preferably at least one solenoid actuated clamp 106 is mounted on the end of the robotic arm 102 for gripping the port barrier frame 42. Preferably, at least two clamps 106 are attached to the arm 102 and are moved inwardly or outwardly by an actuator 108 in order to grip the port barrier frame 42. It will recognized by those skilled in the art from the present disclosure that other types of holding mechanisms could be provided on the end of the robotic arm 102 in order to grip port barrier frames 42 to remove them from the magazine 104 and move them into position in the port opening 28, and the present invention is not limited to the type of mechanism used.

Once the container 50 has been emptied as shown in FIG. 1(*b*), the inner door 90 is closed and the outer door frame 86 is opened by the actuator 88 to move the door assembly 78 away from the port opening 28. As shown in FIGS. 1(*b*) and 1(*c*), the arm 102 is used to remove the next port barrier frame 42' from the magazine 104 and insert the next frame 42' into port opening 28.

As shown in detail in FIG. 6, the next port barrier frame 42' is used displace the first port barrier frame 42 with the attached container 50 out of the port opening 28. The annular seals 36 preventing contamination of the isolated space 22. Preferably, a positive pressure is also maintained within the isolated space 22 to ensure that there is an outflow of air from within the isolated space 22 through any gaps which may form during the insertion of the next port frame 42'.

As shown in FIG. 1(*d*), once the next port barrier frame 42' is in position, the latching mechanism 70 is released such that the hinged arm 66 can be opened and the empty container 50 with the attached port and container barrier films 40 and 60 can be removed and disposed. As the arm 102 is moved back to its starting position, a new container 50' filled with sterilized objects to be transferred into the barrier isolator 12 can be loaded in the container holder 64, as shown in FIG. 1(*e*).

Decontaminated objects 14 are supplied to the decontaminated environment in the isolated space 22 as described above, by clamping the container 50 or 50' to the port opening 28. As shown in FIGS. 1(*f*) and 3, the container 50' or 50 is clamped in position by the latching mechanism 70, which holds the container holder 64 in position with the second side 60*b* of the container barrier film 60 located in facing engagement with the second side 40*b* of the port barrier film. The door assembly 78 is moved from the first position, shown most clearly in FIGS. 1(*b*) and 1(*e*), to the second position, shown in FIG. 1(*f*), to position the parting and sealing element 76 adjacent to the first surface 40*a* of the port barrier film 40, as shown in FIG. 4. Energy is supplied to the parting and sealing element 76 and pressure is applied by the inner door 90 such that the parting and sealing heating 76 simultaneously creates an opening 80 in the port and container barrier films 40, 60 and seals together the edges 82 formed around the opening 80 in the port and container barrier films 40, 60. The inner door 90 is then pivoted outwardly away from the barrier isolator wall 20 as shown in FIG. 1(*a*) and acts as a support for the flap 85 created by the parting and sealing element 76, as shown in FIG. 5. The inner door 90 is used to position the flap 85 for controlled discharge and transfer of the decontaminated objects 14 from within the container 50 through the transfer opening 80 in the port and barrier films 40 and 60, and into the isolated space 22. The isolated space 22 within the barrier isolator 12 remains uncontaminated during transfer since the edges 82 around the opening 80 in the port and container barrier films 40 and 60 are sealed together. Once the contents of the container 50 have been transferred, the inner door 90 is closed, and the outer door frame 86 is opened inwardly, and the process is repeated.

Figure 7:
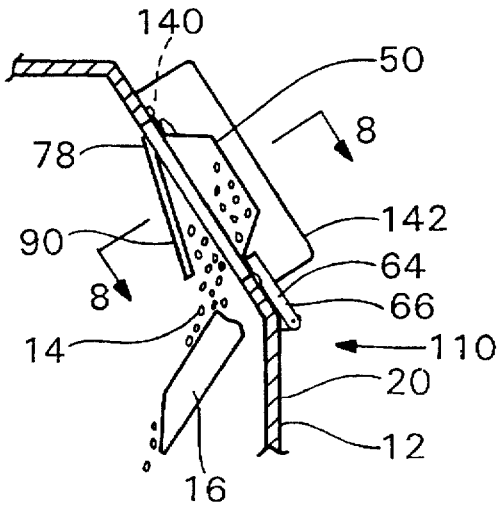
FIG. 7 is a partial elevational view similar to FIG. 1(*a*) illustrating a second embodiment of a transfer system for transferring objects into a barrier isolator.

Referring now to FIG. 7, a second embodiment of a transfer system 110 in accordance with the present invention is shown. The second embodiment 110 is similar to the first embodiment, except that the port barrier film is provided as a pre-sterilized roll 140 of material which is dispensed across the port opening 28. As shown in FIGS. 7 and 8, the pre-sterilized roll of barrier film 140 is rotatably supported in a microbial kill housing 142 located adjacent to the port opening 28. Preferably, the microbial kill housing 142 is a heat box having heating elements 144 located therein adjacent to the pre-sterilized roll of barrier film 140.

The port barrier film 140 is slidably movable across the port opening 28 and seals 151 are provided around the entire outer periphery of the port opening 28 which engage at least one surface of the port barrier film 140. The port and container barrier films 140, 60, are parted and sealed by the parting and sealing element 176, which is similar to the parting and sealing element 76 described in connection with the first embodiment, in the same manner as previously described. However, the raised portion 177 of the parting and sealing element 176 is aligned along an inside edge of the flange 56 so that the shield 58 is not required.

In order to remove the empty container 50 with the attached port barrier film 140, the empty container 50 with the attached port barrier film is slidably displaced until the entire container 50 passes beyond the port opening 28 while additional barrier film material 140 is drawn from the roll across the port opening 28. The seals 151 prevent contaminants from entering through the port opening 28.

While heat is the preferred mode of operation for the parting and sealing element 76 for parting and sealing the barrier films 40, 60, 140, other modes may be used, if desired. For example, ultrasonic welding and cutting can be used to part and seal the barrier films. It may be desirable or necessary in some of the alternative modes to provide supplemental sterilization at the cut edges, such as through the use of UV light, germicides, etc.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A transfer system for transferring objects into a barrier isolator which includes a barrier wall to maintain a decontaminated environment in an isolated space, the transfer system comprising:

a port opening located in the barrier wall to provide access to the isolated space;

a port barrier film sealingly located over the port opening, the port barrier film having a first, decontaminated side which faces the isolated space and a second side which is exposed;

a container adapted to hold the objects to be delivered through the port opening and into the isolated space, the container having an interior cavity adapted to receive decontaminated objects, an exposed exterior, and a flange;

a container barrier film sealingly engaged to the flange such that decontaminated objects are adapted to be sealed within the cavity in the container and remain decontaminated in the cavity, the container barrier film having a first, decontaminated side which faces the cavity, and a second exposed side;

a holder located adjacent to the port opening and adapted to position the container adjacent to the port opening, with the second side of the port barrier film in facing engagement with the second side of the container barrier film;

a parting and sealing element located within the isolated space adjacent to the port opening, mounted for movement from a first position to a second, in-use position adjacent to the first side of the port barrier film, where the parting and sealing element is adapted to part the port and container barrier films to define a transfer opening having edges in the port and container barrier films and to simultaneously seal together and decontaminate the edges of the port and container barrier films such that the exposed and potentially contaminated second sides of the port and container barrier films are locked together and remain isolated from the isolated space, whereby the objects from within the container cavity can be passed through the transfer opening and into the isolated space while maintaining the decontaminated environment.

2. The transfer system of claim 1 wherein the parting and sealing element is aligned with the flange, and a shield is located on the flange to prevent the parting and sealing element from acting on the flange.

3. The transfer system of claim 2 wherein the shield prevents the barrier films from adhering to a portion of the flange.

4. The transfer system of claim 1 wherein the parting and sealing element is aligned along an inside edge of the flange, and an external member applies external pressure to the container for support to part the barrier films.

5. The transfer system of claim 1 further comprising a reinforcement extending around the port opening in the barrier wall, the reinforcement having a surface which surrounds the port opening and a depth, a plurality of spaced apart, annular seals being located on the surface, the port barrier film being mounted in a frame having an outer periphery which is complementary to the port opening, such that the outer periphery of the frame is sealingly engaged by at least one annular seal and is slidably displacable through the port opening.

6. The transfer system of claim 5 wherein a plurality of frames are located within the contained space, each frame having a port barrier film attached thereto and a thickness, and the depth of the reinforcement surface being greater than the thickness of two frames such that a first frame with an associated container connected by the parted and sealed barrier films can be displaced outwardly from the port opening while a second frame is sealingly engaged by at least one annular seal in the port opening to maintain isolation of the isolated space as the first frame is removed.

7. The transfer system of claim 1 wherein the parting and sealing element is adapted to simultaneously seal together and part the port and container barrier films along edges to form a flap.

8. The transfer system of claim 1 wherein the port barrier film is provided as a pre-sterilized roll of material and is dispensed across the port opening.

9. The transfer system of claim 8 wherein the pre-sterilized roll of the port barrier film is rotatably supported in a microbial kill housing located adjacent to the port opening.

10. The transfer system of claim 1 further comprising a flap support which is movable between a first position, in which the flap support is adapted to engage a flap formed by a parted portion of the port and container barrier films and to hold the flap in a closed position, and a second position, in which the support moves away from the port opening and allows the flap to open.

11. The transfer system of claim 1 wherein the parting and sealing element is a heating element.

12. A transfer system for transferring objects into a barrier isolator which includes a barrier wall to maintain a decontaminated environment in an isolated space, the transfer system comprising:

a port opening located in the barrier wall to provide access to the isolated space;

a port barrier film sealingly located on the port opening, the port barrier film having a first, decontaminated side which faces the isolated space and a second side which is exposed;

a container adapted to hold the objects to be delivered through the port opening and into the isolated space, the container having an interior cavity adapted to receive decontaminated objects, an exposed exterior, and a flange;

a container barrier film sealingly engaged to the flange such that decontaminated objects are adapted to be sealed within the cavity in the container and remain decontaminated in the cavity, the container barrier film having a first, decontaminated side which faces the cavity, and a second exposed side;

a holder located adjacent to the port opening and adapted to position the container adjacent to the port opening, with the second side of the port barrier film in facing engagement with the second side of the container barrier film; and a heating element located within the isolated space adjacent to the port opening and alignable with at least a portion of the port and container barrier films.

13. A method of supplying decontaminated objects to a decontaminated environment in an isolated space delimited by a barrier wall, comprising the steps of:

(a) providing a port opening in the barrier wall having a port barrier film with a first, decontaminated side facing the isolated space to close-off the isolated space and a second exposed side;

(b) clamping a container to the port opening, the container having a decontaminated interior cavity with decontaminated objects sealed within the cavity by a container barrier film, the container barrier film having a first decontaminated side and a second exposed side, the second side of the port barrier film being in facing engagement with the second side of the container barrier film;

(c) simultaneously creating a transfer opening in the port and container barrier films and sealing together edges formed around the transfer opening in the port and container barrier films with a parting and sealing element located inside the contained space; and (d) transferring the decontaminated objects from within the container, through the transfer opening in the port and container barrier films, and into the isolated space.

14. The method of claim 13 further comprising the steps of:

(e) sealing the port opening with a next port barrier film;

(f) removing the sealed together port and container barrier films with the container.

15. The method of claim 14 further comprising the step of:

(g) providing a next container;

(h) repeating steps (b), (c) and (d) with the next port barrier film and the next container.

* * * * *